US007458124B1

(12) United States Patent
Leman

(10) Patent No.: US 7,458,124 B1
(45) Date of Patent: Dec. 2, 2008

(54) CLEANING DEVICE

(75) Inventor: Glenn A. Leman, North Attleboro, MA (US)

(73) Assignee: Health Enterprises, Inc., North Attleboro, MA (US)

( * ) Notice: Subject to any disclaimer, the term of this patent is extended or adjusted under 35 U.S.C. 154(b) by 126 days.

(21) Appl. No.: 11/508,698

(22) Filed: Aug. 23, 2006

(51) Int. Cl.
*A47L 25/00* (2006.01)

(52) U.S. Cl. ..... 15/105; 15/185; 7/118; 7/168; 206/234; 206/374

(58) Field of Classification Search ..... 15/105, 15/106, 184, 185; 7/118, 168, 128–131; 81/427.5, 440; 206/234, 373, 374
See application file for complete search history.

(56) References Cited

U.S. PATENT DOCUMENTS 2,473,758 A * 6/1949 Maitlen ..... 15/104.05
2,503,380 A * 4/1950 Derby ..... 206/374
3,364,508 A * 1/1968 Garrett ..... 7/118
4,204,294 A * 5/1980 Halverson ..... 15/185

* cited by examiner

*Primary Examiner*—Mark Spisich
(74) *Attorney, Agent, or Firm*—Salter & Michaelson

(57) ABSTRACT

A multi-purpose hearing aid cleaning device including a housing that includes a pair of housing members that are supported for relative hinging therebetween and that defines open and closed positions. A plurality of cleaning pieces are supported in the housing with each cleaning piece pivotable from a storage position in which the cleaning piece is stored in the housing to a use position in which at least a portion of the cleaning piece extends out of the housing.

19 Claims, 7 Drawing Sheets

CLEANING DEVICE

TECHNICAL FIELD

The present invention relates, in general, to a cleaning device for hearing aids, and pertains more particularly to a cleaning device having multiple tools for cleaning the hearing aid and for replacing the battery.

BACKGROUND OF THE INVENTION

The majority of hearing aids require repair due to moisture and ear wax build-up. Most of these repairs are preventable with proper daily maintenance. In making these repairs, many times it is helpful to employ a number of different types of tools. However, there is not presently available any device that combines all the necessary tools in providing proper maintenance.

Accordingly, it is an object of the present invention to provide a compact, hand-held device which incorporates all of the necessary tools to facilitate daily cleaning.

It is another object of the present invention to provide a hearing aid cleaning device that is relatively inexpensive and easy to use.

It is still another object of the present invention to provide a hearing aid cleaning device which enables one of many tools to be easily selected to perform the desired cleaning or maintenance.

It is another object of the present invention to provide a cleaning device which also has compartments for holding batteries or other items necessary for hearing aid maintenance.

SUMMARY OF THE INVENTION

In accordance with the foregoing and other objects, features and advantages of the invention there is provided a multi-purpose cleaning device that is comprised of a housing that includes a pair of housing members that are supported for relative hinging therebetween and that defines open and closed positions, and a plurality of cleaning pieces supported in the housing with each cleaning piece pivotable from a storage position in which the cleaning piece is stored and in the housing to a use position in which at least a portion of the cleaning piece extends out of the housing.

In accordance with further aspects of the present invention, the pair of housing members may include a bottom housing member having sidewalls and a top housing member having a locking tab for releaseable engagement with a shoulder in one sidewall of the bottom housing member. The bottom housing member has at least one ridge along the outside of each sidewall for facilitating opening the housing when in the closed position. The bottom housing member may also include one separate storage compartment. The top housing member may have one cross-shaped retainer that is disposed over the storage compartment to retain the contents therein when the device is in its closed position. The top housing member also may have posts that engage with extended cleaning pieces to lock the cleaning pieces into grooves in the bottom housing member when the pieces are in their use position when the housing is in the closed position.

In accordance with further aspects of the present invention, the cleaning pieces are supported for pivoting along a common pivot axis. There also may be provided a pair of pivot posts at the bottom of one of said housing members that form pivots for respective cleaning pieces. The cleaning device may also include adjacent spaced pairs of pivot posts for supporting the base with the cleaning pieces pivotal therebetween.

In accordance with further aspects of the present invention, each cleaning piece has a tool end and an opposite pivot end including a base that is received between the pivot posts. The shaft may also have a release tab to be adapted to be received in a hole in the housing in the storage position and a flange on the opposite side of the shaft for moving each cleaning piece from the storage position to the use position.

In accordance with another embodiment of the present invention there is provided a multi-purpose hearing aid cleaning device that is comprised of a case that includes a top housing member and a bottom housing member that are supported for relative pivoting therebetween to provide an open position and a closed position thereof and a plurality of cleaning elements supported in the bottom housing member. Each cleaning element is pivotable from a storage position in which the cleaning element is stored in the bottom housing to a use position in which the cleaning element extends out of the bottom housing. Each cleaning element has a shaft with a pivot end and an opposite tool end, the shaft of each cleaning element including means manually engageable to assist in the pivoting of each cleaning element from its storage position to its use position.

In accordance with further aspects of the present invention, the manually engageable means include a flange disposed on the top side of the shaft. The manually engageable means may further include a release tab disposed on the bottom side of the shaft and adapted to be received in a hole in the bottom housing member in the storage position to be pushed upward to pivot the cleaning element to its use position.

In accordance with further aspects of the present invention, the tool end of the cleaning piece is selected from the group comprising at least one of a wax removal brush, a wax removal pick, a tube and vent cleaner, a battery door opener, and a battery replacement magnet.

In accordance with still another embodiment of the present invention, there is provided a multi-purpose hearing aid cleaning device that is comprised of a case that includes a top housing member and a bottom housing member that are supported for relative pivoting therebetween to provide an open position and a closed position thereof, a plurality of cleaning elements supported in the bottom housing member, each cleaning element pivotable from a storage position in which the cleaning element is stored in the bottom housing to a use position in which the cleaning element extends out of the bottom housing, each cleaning element has a shaft with a pivot end and an opposite tool end, and a plurality of retaining posts in the top housing member, each engageable with a corresponding cleaning element in its use position.

In accordance with further aspects of the present invention, the shaft of each cleaning element includes means manually engageable to assist in the pivoting of each cleaning element from its storage position to its use position. The manually engageable means may include a release tab adapted to be received in a hole in the housing in the storage position and a flange on the opposite side of the shaft for moving each cleaning piece from the storage position to the use position.

In accordance with further aspects of the present invention, the bottom housing member may have at least one ridge along the outside of each sidewall for facilitating opening the case when in the closed position. The bottom housing member may include at least one separate storage compartment and the top housing member may have at least one cross shaped retainer that is disposed over the at least one storage compartment to retain the contents therein when the case is closed.

The top housing member may have posts that engage with extended cleaning pieces to lock the cleaning pieces into grooves in the bottom housing member in their use position when the case is in its closed position. In accordance with further aspects of the present invention, all of the cleaning pieces are supported for pivoting along a common axis. The bottom housing member includes a pair of pivot posts that form pivots for respective cleaning pieces and each cleaning piece has a shaft having a pivot end and an opposite tool end and the pivot end may include a base that is received between the pivot posts. The tool end may be selected from the group comprising at least one of a wax removal brush, a wax removal pick, a tube and vent cleaner, a battery door opener, and a battery replacement magnet.

BRIEF DESCRIPTION OF THE DRAWINGS

Numerous other objects, features and advantages of the present invention should now become apparent upon a reading of the following detailed description taken in conjunction with the accompanying drawings, in which.

DETAILED DESCRIPTION

Figure 1:
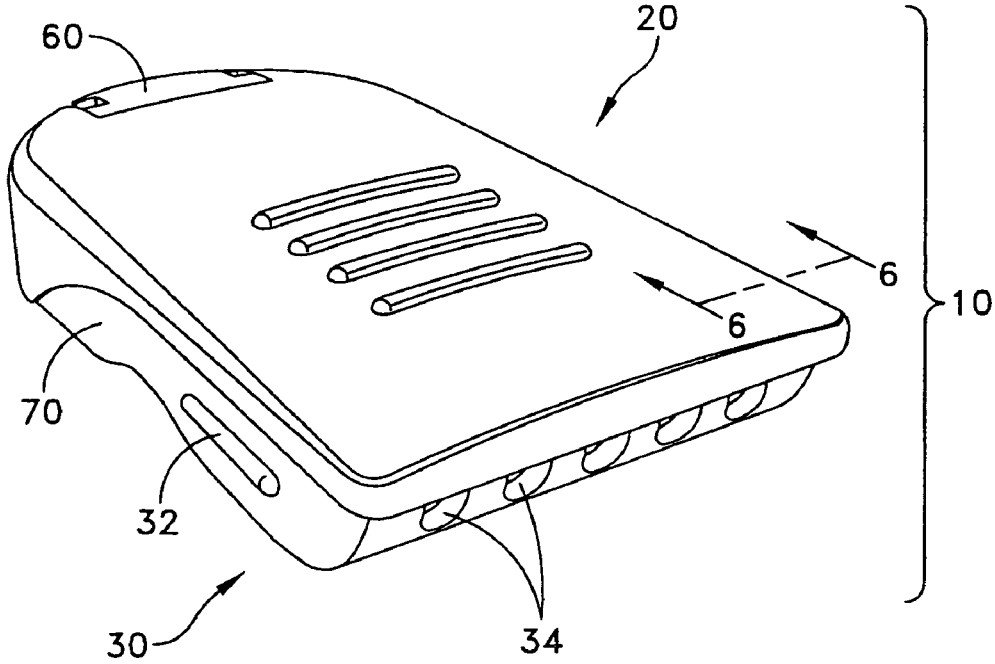
FIG. 1 is a top perspective view of one embodiment of the cleaning device with the case in its closed position.

Referring now to the drawings, a preferred embodiment of the present invention is illustrated in FIGS. 1-8. The cleaning device includes a case 10 that includes a top housing member 20 and a bottom housing member 30. A plurality of cleaning elements 40 are supported in the bottom housing member 30 and are constructed and arranged so as to individually pivot between a storage position and a use position. By way of example, in FIG. 2 four of the cleaning elements 40 are illustrated in their storage position and one of the cleaning elements 40 is illustrated extending from the case in its use position. Both of the housing members 20 and 30 may be constructed of a plastic or light-weight metal material.

Reference is now made to FIG. 1 which is a top perspective view of the cleaning device with the case 10 in its closed position, without any of the cleaning elements 40 extended to their use position. The top housing member 20 and bottom housing member 30 are hinged together via hinge 60. As noted in FIGS. 1 and 2 the opposite sidewalls 70 of the bottom housing member 30 are provided with a ridge 32. The ridge 32 makes it easier for the user to grasp the case 10 to open and close the case.

Figure 3:
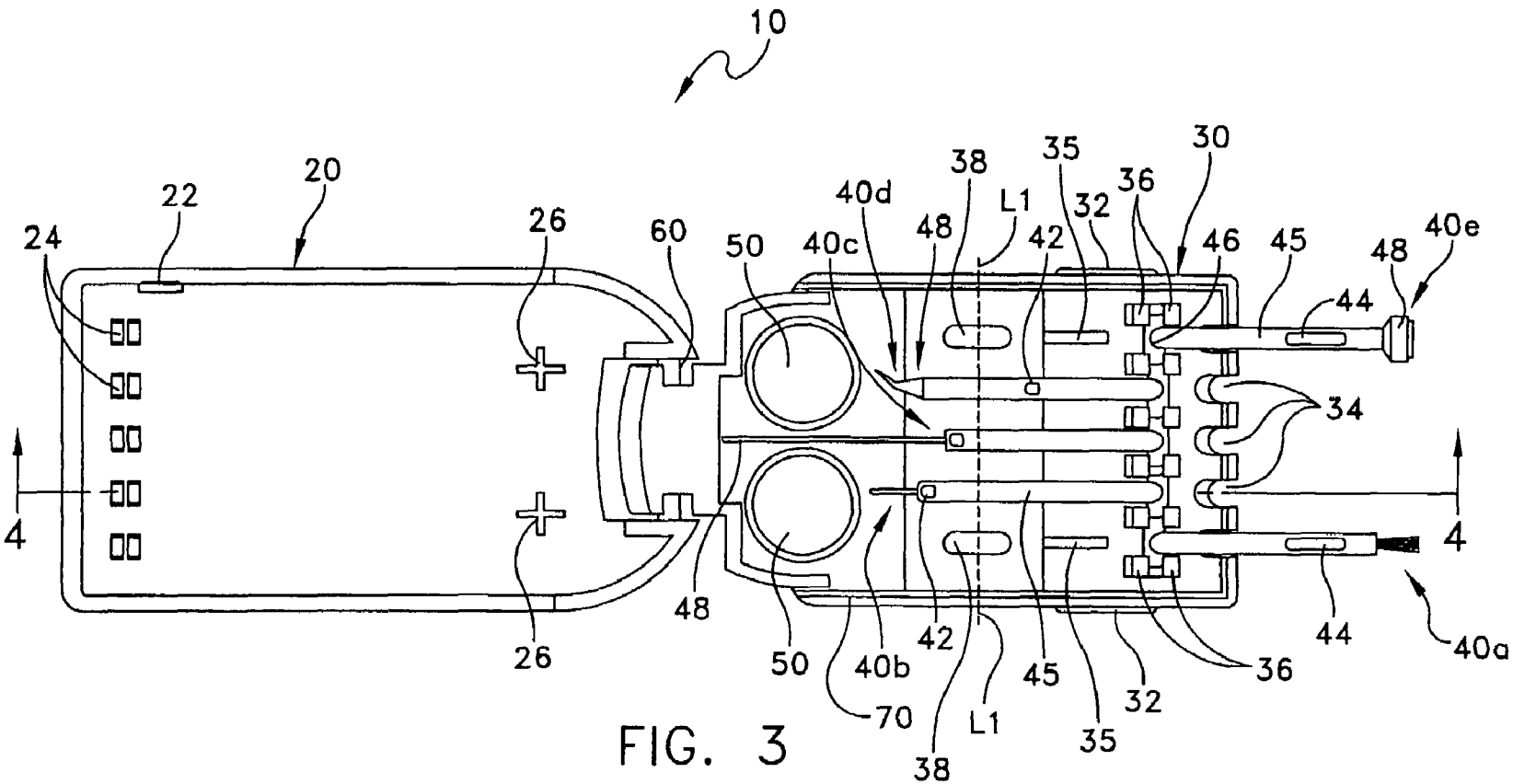
FIG. 3 is a plan view of the cleaning device with the case in its open position with two tools extended.
Figure 4:
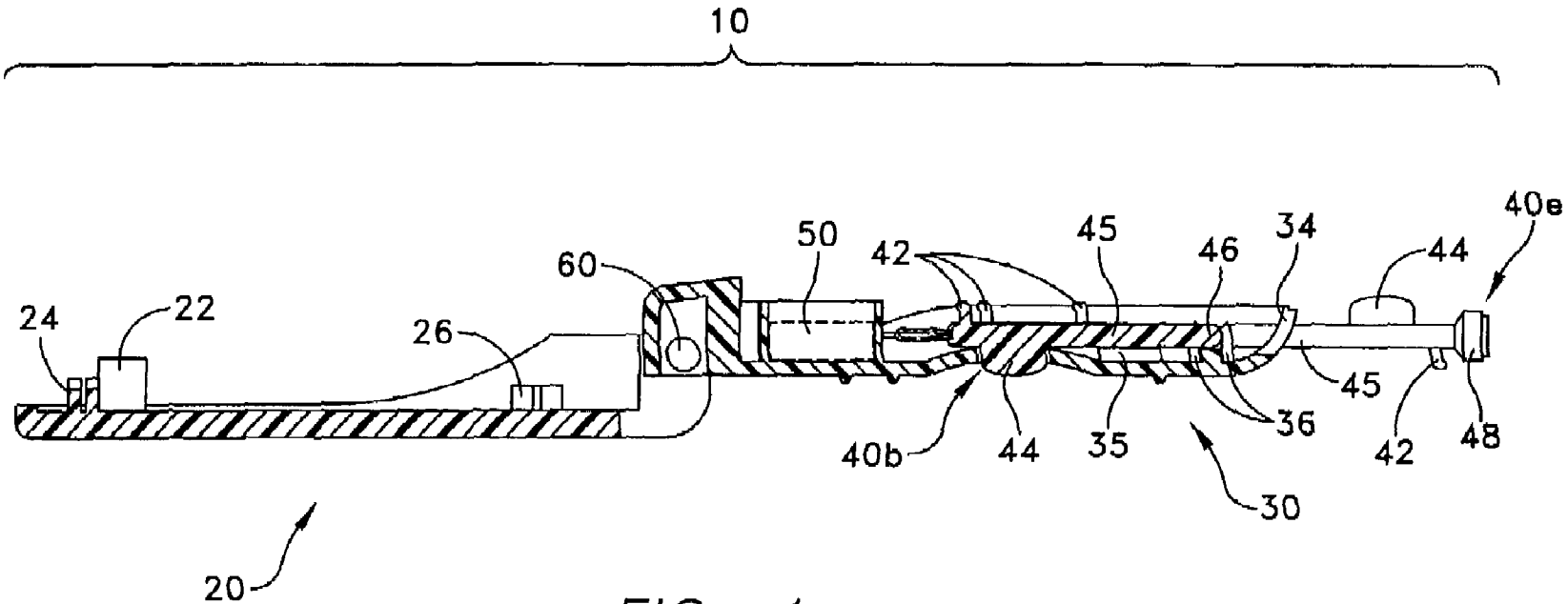
FIG. 4 is a cross-sectional view along line 4-4 of FIG. 3 with the case in its open position.

Referring now to FIG. 3, this illustrates the cleaning device in a plan view with the case in its open position. This illustrates five cleaning elements 40 identified as cleaning elements 40*a*, 40*b*, 40*c*, 40*d* and 40*e*. The cleaning elements 40*b*, 40*c*, and 40*d* are illustrated in their storage position while the cleaning elements 40*a* and 40*e* are illustrated in its use position. Each cleaning element 40 includes a somewhat elongated shaft 45, a pivot end 46 and a tool end 48. When the cleaning element 40 is in its storage position, the shaft 45 is disposed on a rest 35. This is depicted in FIG. 4 in which the shaft 45 of cleaning element 40*b* is resting on rest 35 in its storage position. The pivot end 46 is received at the pivot posts 36 which are integrally molded with the bottom wall of the bottom housing 30. The tool end 48 of each cleaning element 40 is different on each cleaning element to provide a complete tool set for daily maintenance. For example, in one embodiment of the present invention, the tool end 48 of the cleaning elements are: 40*a* is a wax removal brush, 40*b* is a wax removal pick, 40*c* is a tube and vent cleaner, 40*d* is a battery door opener and 40*e* is a battery replacement magnet.

Figure 2:
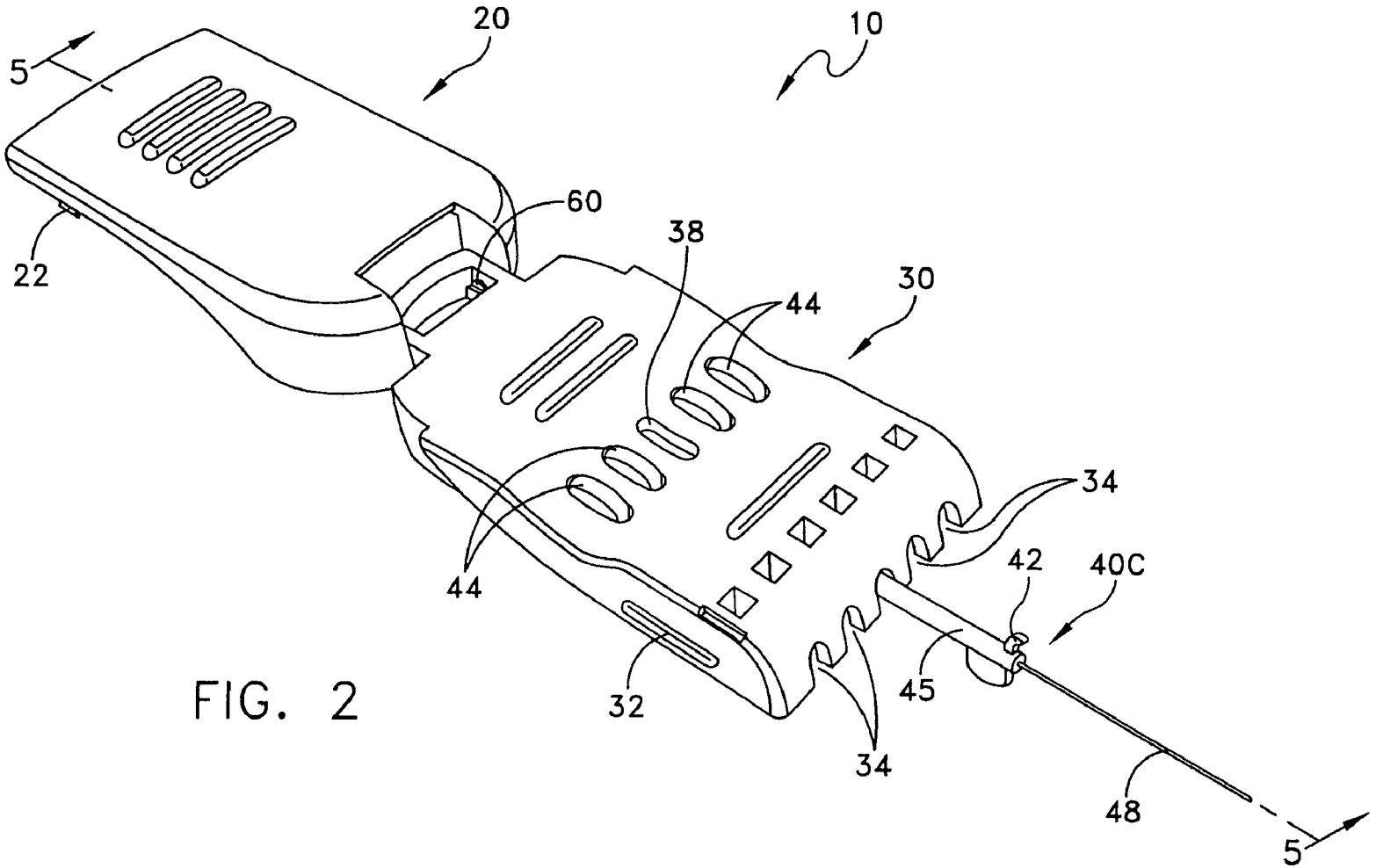
FIG. 2 is a bottom perspective view of the cleaning device with one tool extended with the case in its open position.
Figure 8:
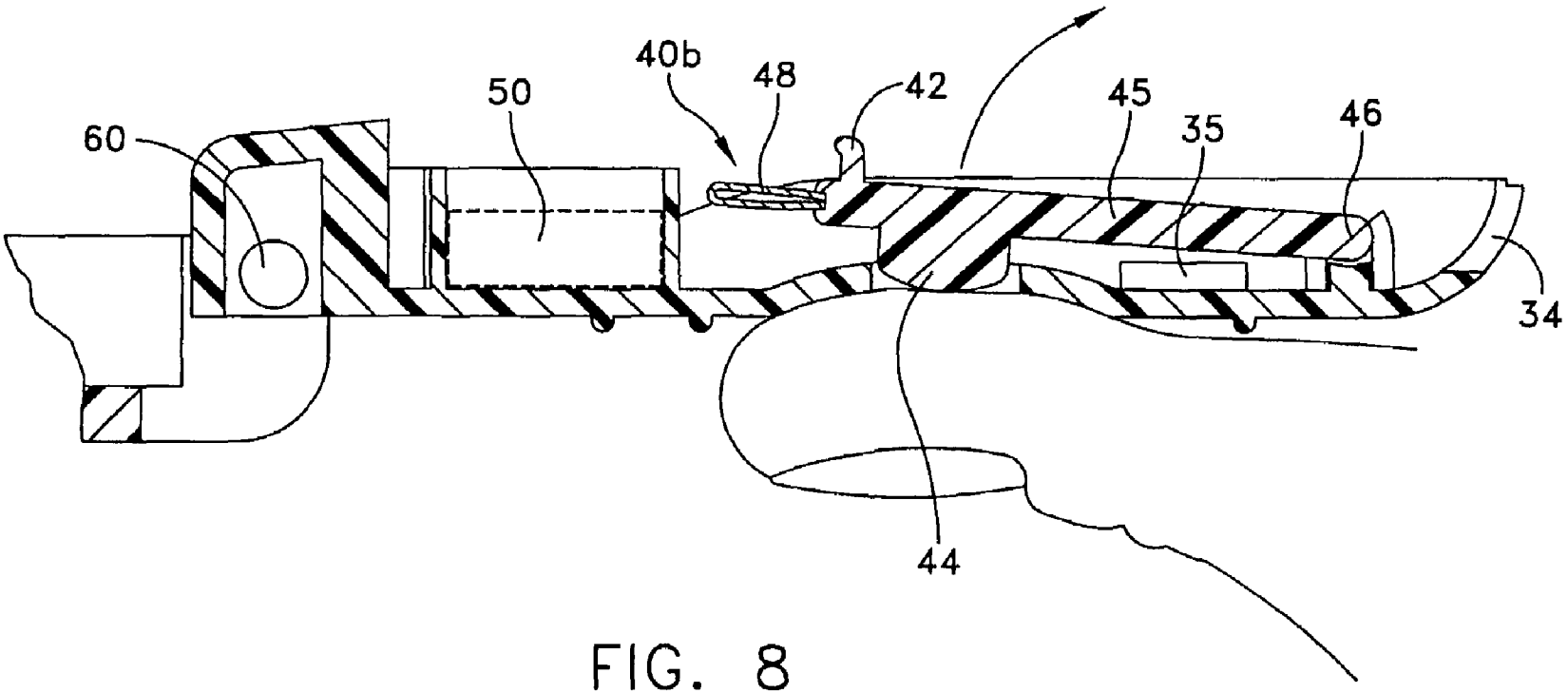
FIG. 8 is a fragmentary cross-sectional view like that shown in FIG. 4 with the case in an open position and illustrating initial releasing of the cleaning piece.

Each cleaning element 40 has a flange 42 for manual engagement to assist in moving the cleaning element from the storage position to the use position. As noted in FIG. 3 the flanges 42 are disposed at different longitudinal positions along each of the respective cleaning elements. This makes it easier to grasp a particular flange without interfering with adjacent tools. Each cleaning element 40 is also provided with a release tab 44 as depicted in FIGS. 2, 3 and 8. It is noted that the release tab 44 is provided on the opposite side of the shaft 45 to the flange 42. The release tabs 44 are all disposed along the same transverse line L1 which corresponds to the same placement of the slightly elongated holes 38 that receive these tabs. Refer to FIG. 3.

Referring now to FIG. 2, which is a bottom view of the cleaning device with case 10 in its open position, release tabs 44 are disposed in holes 38 of the bottom housing member 30. These release tabs 44 may also be manually engaged by the user to select the desired cleaning element 40 by pushing upward, as depicted in greater detail in FIG. 8 which is a cross-sectional side view of the cleaning device. The cleaning elements 40 are then further manually moved to their use position by manually grasping the flange 42. In FIG. 2 the cleaning element 40*c* is in its use position and is supported in its corresponding groove 34 of the bottom housing member 30. It is noted that in FIG. 2 the device is shown with one tool extending and with the case open. In use the case 10 is closed to grasp the single tool.

Figure 5:
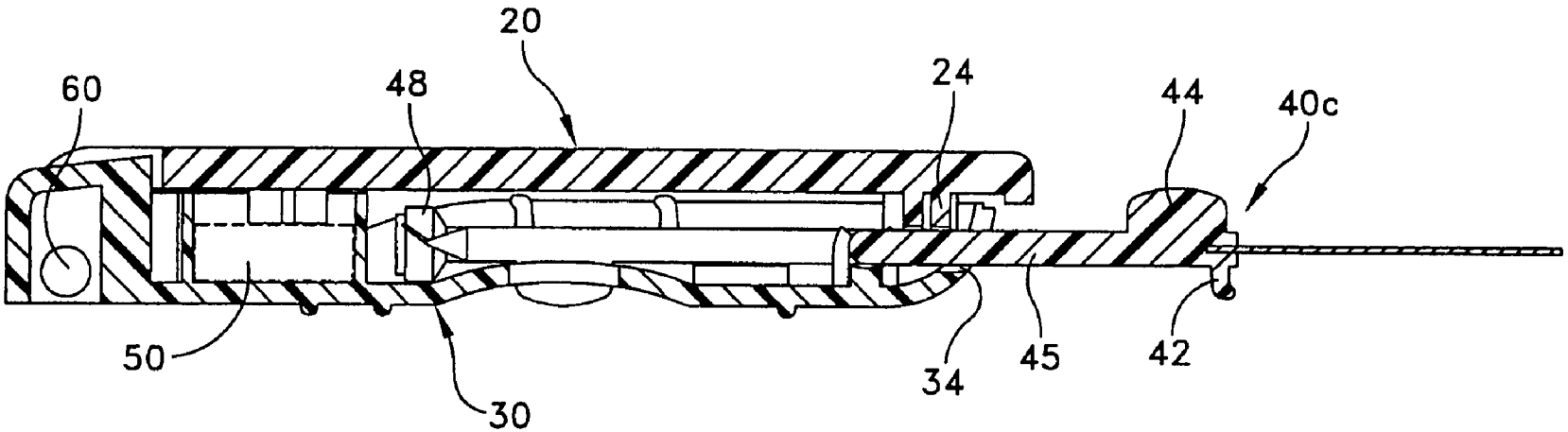
FIG. 5 is a cross-sectional view along line 5-5 of FIG. 2 but with the case in its closed position.

Once the desired cleaning element 40 has been selected, the user manually closes the case 10 to its closed position to use the cleaning element. Normally, only one cleaning element at a time would extend from the case for its use. FIG. 5 is a cross-sectional view taken along line 5-5 of FIG. 2 but with the case is in its closed position. The cleaning element 40 is held in place in groove 34 by a pair of posts 24 which are integrally molded with the top housing member 20. As depicted in FIG. 5, the posts 24 are urged against the cleaning element 40*c* to secure it in place. In the present embodiment of the invention, a pair of posts 24 is used to secure the cleaning element in place, however alternatively it may be held in place by one single post.

There is also depicted in FIG. 3 two containers or compartments 50 which may be used to store batteries or other items necessary for hearing aid maintenance. The retainers 26 are integrally molded with the top housing member 20 and, as depicted, are cross-shaped but may be other shapes. These retainers 26 are disposed over the storage compartments 50 to retain the contents therein in the closed position of the case 10. It is also noted that the compartments 50 may be spaced apart so as to allow for a longer tool end 48 on the cleaning element 40*c*.

Reference is now made to FIG. 4 which is a cross-sectional view taken along line 4-4 of FIG. 3 as taken through cleaning element 40*b* that is in its storage position with the case 10 in its open position. FIG. 4 illustrates the cleaning element 40*b* in cross section with its associated release tab 44 extending in hole 38. FIG. 4 also depicts the tool 40*e* extending from the case 10.

Figure 7:
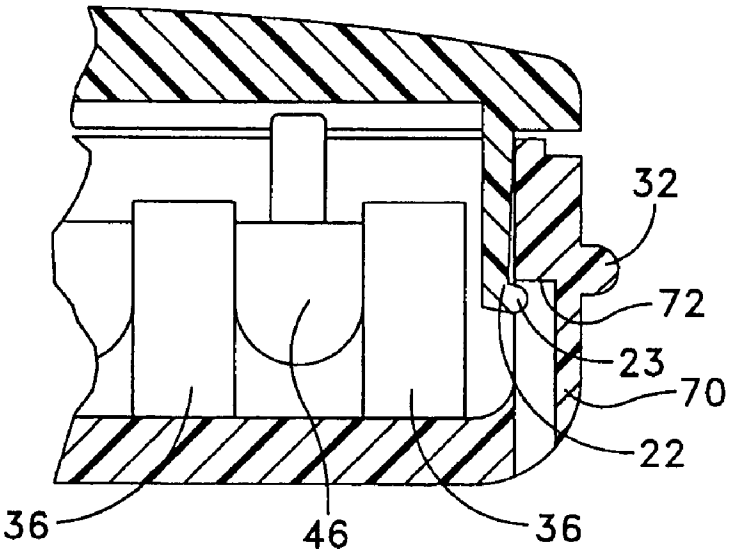
FIG. 7 is a fragmentary cross-sectional view as taken along line 6-6 of FIG. 1 with the case in its fully closed position.
Figure 6:
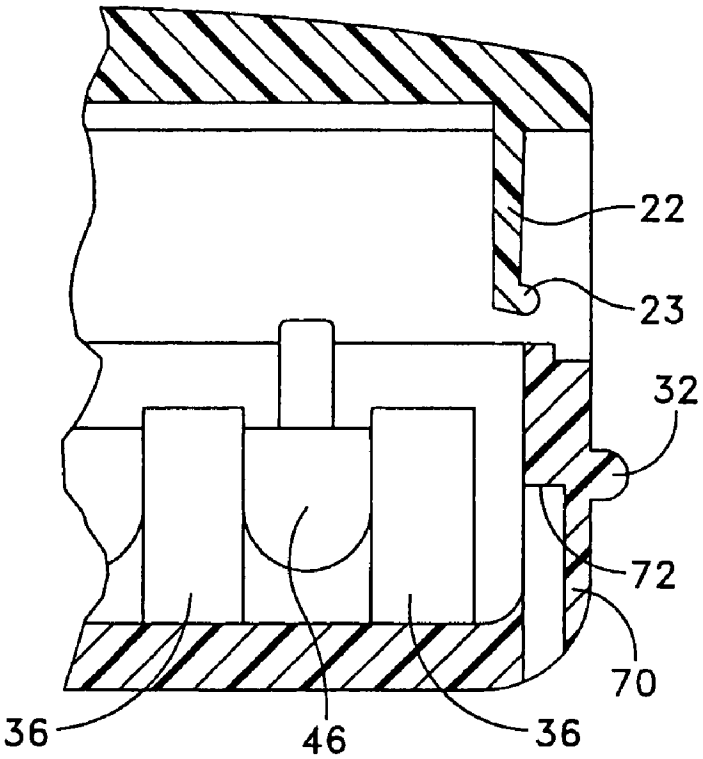
FIG. 6 is a fragmentary cross-sectional view as taken along line 6-6 of FIG. 1 but with the case just before a fully closed position in the open position.

Reference is now made to FIGS. 6 and 7 which are fragmentary cross-sectional views depicting the sequence of closure of the case 10. In FIG. 6 the case 10 is depicted in a position just before it is closed and in FIG. 7 it is depicted in a fully closed position. For the purpose of holding the case 10 closed, there is provided an inter-engagement between the tab 22 that extends from the top housing member 20 and the shoulder 72 in the sidewall 70 of the bottom housing member 30. A detent arrangement is provided between these elements which includes an end rib 23 that is adapted to engage at the shoulder 72 as shown in the locked position of FIG. 7. When it is desired to move the case 10 to its open position, the ridges 32, as depicted in FIG. 1, assist as finger grips to enable opening of the case 10, snapping the end rib 23 away from the shoulder 72.

Having now described a limited number of embodiments of the present invention, it should now become apparent to one skilled in the art that numerous other embodiments and modifications thereof are contemplated as falling within the scope of the present invention as defined by the appended claims. For example, although representative tools have been shown, other devices may include still further types of cleaning tools. Also, fewer or greater numbers of tools may be supported in a similar manner.

What is claimed is:

1. A multi-purpose cleaning device comprising:

a housing that includes a pair of housing members that are supported for relative hinging therebetween and that defines open and closed positions; and a plurality of cleaning pieces supported in said housing with each said cleaning piece pivotable from a storage position in which the cleaning piece is stored in said housing to a use position in which at least a portion of said cleaning piece extends out of said housing;

each said cleaning piece including a pivot end, a tool end and a shaft that interconnects the pivot and tool ends;

said pair of housing members including a bottom housing member and a top housing member;

the top housing member having at least one post that engages with a respective extended cleaning piece shaft to immovably lock the shaft into a corresponding groove in the bottom housing member in the use position.

2. The cleaning device of claim 1 wherein said bottom housing member has sidewalls and said top housing member has a locking tab for releasable engagement with a shoulder in one sidewall of the bottom housing member.

3. The cleaning device of claim 2 wherein said bottom housing member has at least one ridge along the outside of each sidewall for facilitating opening the housing when in the closed position.

4. The cleaning device of claim 2 wherein said bottom housing member includes at least one separate storage compartment.

5. The cleaning device of claim 1 wherein all of said cleaning pieces are supported for pivoting along a common pivot axis and the at least one post is disposed spaced inwardly of the housing groove.

6. A multi-purpose cleaning device comprising:

a housing that includes a pair of housing members that are supported for relative hinging therebetween and that defines open and closed positions; and a plurality of cleaning pieces supported in said housing with each said cleaning piece pivotable from a storage position in which the cleaning piece is stored in said housing to a use position in which at least a portion of said cleaning piece extends out of said housing;

wherein said pair of housing members include a bottom housing member having sidewalls and a top housing member having a locking tab for releasable engagement with a shoulder in one sidewall of the bottom housing member;

wherein said bottom housing member includes at least one separate storage compartment; and wherein said top housing member has at least one cross shaped retainer that is disposed over the at least one storage compartment to retain the contents therein when the device is closed.

7. A multi-purpose cleaning device comprising:

a housing that includes a pair of housing members that are supported for relative hinging therebetween and that defines open and closed positions; and a plurality of cleaning pieces supported in said housing with each said cleaning piece pivotable from a storage position in which the cleaning piece is stored in said housing to a use position in which at least a portion of said cleaning piece extends out of said housing;

wherein said pair of housing members include a bottom housing member having sidewalls and a top housing member having a locking tab for releasable engagement with a shoulder in one sidewall of the bottom housing member; and wherein said top housing member has posts that engage with respective extended cleaning pieces to lock the cleaning pieces into grooves in the bottom housing member in their use position when the housing is in its closed position.

8. A multi-purpose cleaning device comprising:

a housing that includes a pair of housing members that are supported for relative hinging therebetween and that defines open and closed positions; and a plurality of cleaning pieces supported in said housing with each said cleaning piece pivotable from a storage position in which the cleaning piece is stored in said housing to a use position in which at least a portion of said cleaning piece extends out of said housing;

wherein all of said cleaning pieces are supported for pivoting along a common pivot axis;

including pairs of pivot posts at the bottom of one of said housing members that form pivots for respective cleaning pieces.

9. The cleaning device of claim 8 including adjacent spaced pairs of pivot posts for supporting the cleaning piece with said cleaning piece pivotal therebetween.

10. The cleaning device of claim 8 wherein each cleaning piece has a shaft having a pivot end and an opposite tool end, said pivot end including a base that is received between said pivot posts.

11. The cleaning device of claim 10 wherein said shaft has a release tab adapted to be received in a hole in the housing in the storage position and a flange on the opposite side of the shaft for moving each cleaning piece from the storage position to the use position.

12. A multi-purpose hearing aid cleaning device comprising:

a case that includes a top housing member and a bottom housing member that are supported for relative pivoting therebetween to provide an open position and a closed position thereof; and a plurality of cleaning elements supported in said bottom housing member;

wherein each cleaning element is pivotable from a storage position in which the cleaning element is stored in said bottom housing to a use position in which the cleaning element extends out of said bottom housing; and wherein each cleaning element has a shaft with a pivot end and an opposite tool end, said shaft of each cleaning element including means manually engageable to assist in the pivoting of each cleaning element from its storage position to its use position;

wherein said manually engageable means include an outwardly extending flange disposed from the top side of the shaft;

wherein at least some of the respective flanges are disposed at different longitudinal positions along the shaft;

and wherein the pivot end of all cleaning elements are supported along a common axis.

13. The cleaning device of claim 12 including a release tab disposed on the bottom side of the shaft and adapted to be received in a hole in the bottom housing member in the storage position to be pushed upward to pivot the cleaning element to its use position.

14. The cleaning device of claim 12 wherein said tool end is selected from the group comprising at least one of a wax removal brush, a wax removal pick, a tube and vent cleaner, a battery door opener, and a battery replacement magnet.

15. A multi-purpose hearing aid cleaning device comprising:

a case that includes a top housing member and a bottom housing member that are supported for relative pivoting therebetween to provide an open position and a closed position thereof; and a plurality of cleaning elements supported in said bottom housing member;

wherein each cleaning element is pivotable from a storage position in which the cleaning element is stored in said bottom housing to a use position in which the cleaning element extends out of said bottom housing; and wherein each cleaning element has a shaft with a pivot end and an opposite tool end, said shaft of each cleaning element including means manually engageable to assist in the pivoting of each cleaning element from its storage position to its use position;

wherein said manually engageable means include a flange disposed on the top side of the shaft; and wherein said manually engageable means further include a release tab disposed on the bottom side of the shaft and adapted to be received in a hole in the bottom housing member in the storage position to be pushed upward to pivot the cleaning element to its use position.

16. A multi-purpose hearing aid cleaning device comprising:

a case that includes a top housing member and a bottom housing member that are supported for relative pivoting therebetween to provide an open position and a closed position thereof; and a plurality of cleaning elements supported in said bottom housing member;

wherein each cleaning element is pivotable from a storage position in which the cleaning element is stored in said bottom housing to a use position in which the cleaning element extends out of said bottom housing; and wherein each cleaning element has a shaft with a pivot end and an opposite tool end, said shaft of each cleaning element including means manually engageable to assist in the pivoting of each cleaning element from its storage position to its use position; and wherein said manually engageable means include a release tab disposed on the bottom side of the shaft and adapted to be received in a hole in the bottom housing member in the storage position to be pushed upward to pivot the cleaning element to its use position.

17. A multi-purpose hearing aid cleaning device comprising:

a case that includes a top housing member and a bottom housing member that are supported for relative pivoting therebetween to provide an open position and a closed position thereof;

a plurality of cleaning elements supported in said bottom housing member;

each cleaning element being pivotable from a storage position in which the cleaning element is stored in said bottom housing to a use position in which the cleaning element extends out of said bottom housing;

each cleaning element having a shaft with a pivot end and an opposite tool end;

and a release tab disposed on the bottom side of the shaft and adapted to be received in a hole in the bottom housing member in the storage position to be pushed upward to pivot the cleaning element toward its use position.

18. The cleaning device of claim 17 wherein the shaft of each cleaning element including means manually engageable to assist in the pivoting of each cleaning element from its storage position to its use position.

19. A multi-purpose hearing aid cleaning device comprising:

a case that includes a top housing member and a bottom housing member that are supported for relative pivoting therebetween to provide an open position and a closed position thereof;

a plurality of cleaning elements supported in said bottom housing member;

each cleaning element being pivotable from a storage position in which the cleaning element is stored in said bottom housing to a use position in which the cleaning element extends out of said bottom housing;

each cleaning element having a shaft with a pivot end and an opposite tool end;

and a plurality of retaining posts in the top housing member, each engageable with a corresponding cleaning element in its use position;

wherein the shaft of each cleaning element including means manually engageable to assist in the pivoting of each cleaning element from its storage position to its use position; and wherein said manually engageable means includes a release tab adapted to be received in a hole in the housing in the storage position and a flange on the opposite side of the shaft for moving each cleaning piece from the storage position to the use position.

* * * * *